United States Patent [19]

Jackson

[11] Patent Number: 4,567,215

[45] Date of Patent: Jan. 28, 1986

[54] PRODUCT AND PROCESS RELATING TO HARDBOARD

[75] Inventor: Fred L. Jackson, Littleton, Colo.

[73] Assignee: Manville Service Corporation, Denver, Colo.

[21] Appl. No.: 709,639

[22] Filed: Mar. 8, 1985

[51] Int. Cl.[4] ..... C08K 3/34

[52] U.S. Cl. ..... 523/218; 162/165; 162/172; 162/181.6; 523/219; 524/13; 524/14

[58] Field of Search ..... 523/218, 219; 524/13, 524/14; 162/165, 172, 181.6

[56] References Cited

U.S. PATENT DOCUMENTS

| | | | |
|---|---|---|---|
| 3,042,578 | 7/1962 | Denning | 162/171 |
| 3,408,316 | 10/1968 | Mueller et al. | 523/218 |
| 3,623,938 | 11/1971 | Jenkins | 161/159 |
| 3,988,199 | 10/1976 | Hillmer et al. | 162/181.6 |
| 4,118,273 | 10/1978 | Godin et al. | 162/171 |
| 4,126,512 | 11/1978 | Hill | 162/171 |
| 4,313,997 | 2/1982 | Ruff et al. | 428/220 |
| 4,325,849 | 4/1982 | Rosen et al. | 252/62 |
| 4,411,738 | 10/1983 | Wittrup et al. | 162/165 |

FOREIGN PATENT DOCUMENTS

| | | | |
|---|---|---|---|
| 543519 | 7/1957 | Canada | 162/181.6 |

*Primary Examiner*—Lewis T. Jacobs

*Attorney, Agent, or Firm*—John D. Lister; Gregory A. Evearitt

[57] ABSTRACT

A novel economical hardboard is provided which comprises (a) about 1–40 wt % of a porous additive having a particle size in the range of about 0.1–2 mm; (b) about 65–97 wt % of cellulose fibers; (c) about 2–5 wt % binder; and (d) about 1–4 wt % wax. Also provided is an efficient economical process for the production of the above described inventive hardboard comprising the steps of formulating an aqueous mixture of the above ingredients, then dewatering the aqueous mixture, and finally heating the mixture at a temperature and time sufficient to cure the binder.

24 Claims, No Drawings

PRODUCT AND PROCESS RELATING TO HARDBOARD

This invention relates to a novel hardboard product. It also relates to a novel, improved process for the manufacture of hardboard.

Hardboard is a generic term for a panel manufactured from cellulose fibers and a synthetic resin binder. Typical commercial usages of hardboard include, but are not limited to, siding on houses and backings for furniture.

The conventional process for making hardboard involves the initial step of making an aqueous mixture comprising the fiber and binder. Subsequently, the mixture is dewatered, usually in a cold press. Finally, the dewatered mixture is sent to a three-stage hot press operation. In the first hot press stage, the mixture is pressed to a high pressure in order to remove any remaining water. In the second stage, the pressure is lowered to achieve out-gassing. The third stage involves pressing the board to the desired thickness. During the three-step hot press operation, the binder of the final hardboard product is cured.

One disadvantage encountered with the conventional process is the hot press operation. Because three steps are involved, the hot press operation is very much a limiting factor in the manufacture time for hardboard. Utilizing an efficient yet less time consuming process would save production costs in terms of both time and energy.

Improvements can be made in the conventional hardboard product of cellulose fiber and binder as well. Such hardboard products tend to be relatively dense and expensive. Additionally their high fiber content affects the dimensional stability of the board because of the fibers' sensitivity to hot and cold fluctuations. The machinability (i.e. ability to cut edges and grooves) of the conventional hardboard is sometimes poor resulting in the unpleasing appearance of jagged edges.

Research was conducted in order to find an improved yet efficient process for the production of a quality hardboard product. During the course of such research, it was discovered that the addition of certain porous additives, such as expanded perlite, in the hardboard formulation as a partial replacement for the cellulose fiber results in both an improved hardboard manufacturing process and product.

By partially replacing cellulose fiber with a porous additive such as expanded perlite, improvements in both the production process and hardboard product result. With regard to the production time, the latter is not only shortened but made less energy intensive as well. The porous nature of the additives permits greater dewatering of the hardboard during the cold press operation. Equally as important is the fact that the three-stage hot press can be cut down to one stage wherein less pressure is required to completely dewater, out-gas, and cure the final hardboard product. Through all of this, a more efficient, economical product process results.

With regard to the porous additive containing hardboard product itself there are several advantages as well. Because of the partial replacement of cellulose with a lighter weight porous additive such as expanded perlite, the density of the product is lowered. Also, the dimensional stability of the hardboard product is improved because the porous additive is much less susceptible to expansion or contraction depending upon temperature fluctuations as compared to the cellulose fibers. The addition of perlite to hardboard also results in an improved machinability of the final product because lesser amounts of sometimes rugged cellulose fibers exist in the product than before. Finally, the addition of a porous additive such as expanded perlite to hardboard results in a lower costs for hardboard despite the higher raw material (porous additive) costs because of the reduced board density and increased production rates.

Therefore, an object of this invention is to provide a novel, economical yet quality hardboard product. Another object of this invention is to provide a novel and improved process for the manufacture of hardboard.

Other aspects, objects, and advantages of the present invention are apparent from this specification and appended claims.

In accordance with one embodiment of the present invention, a novel, economical, yet quality hardboard product is provided. Broadly, this inventive hardboard comprises:

(a) about 1–40 wt % of a porous additive having a partical size in the range of about 0.1–2 mm;
(b) about 65–97 wt % cellulose fibers;
(c) about 2–5 wt % binder; and
(d) about 1–4 wt % wax.

Preferably, the hardboard will comprise about 5–15 wt % porous additive, about 87–95 wt % cellulose fibers, about 2–3 wt % binder, and about 1–2 wt % wax.

According to the present invention, the cellulose fiber is partially replaced by a porous additive. Generally, the porous additive will have a particle size of about 0.1–2 mm, preferably about 0.5–1.5 mm. The density of the porous additive will broadly be about 3 to 30 pcf, preferably about 3 to 9 pcf.

The strength of the porous additive is preferably 10–100 psi, most preferably about 50–100 psi.

Examples of porous additives which may be utilized in the present invention include but are not limited to vermiculite, expanded clay, foamed glass, lightweight pumice, pumicite, and expanded perlite with expanded perlite preferred.

Any commercially available type of cellulose fibers such as kraft fibers and wood fibers may be used in the present invention. Wood fibers are preferred. Wood fibers are made from wood-cellulose (xylon).

In the present invention any commercially available suitable binder may be utilized. As used herein, a suitable binder is defined as being an inorganic or organic based binder which is compatible with the cellulose fibers, porous additives, and other optional ingredients utilized in the hardboard product.

The use of organic binders is presently preferred. Phenolic binder resins are especially preferred.

Phenolic resins suitable for use in the present invention are thermosetting, base catalyzed, resinous condensation products (soluble in aqueous solvents) of one or more hydroxy aromatic compounds (phenols) and one or more suitable aldehyde materials. "Aldehydic," as employed herein, refers to aldehydes and similarly acting materials. From about 1.8 to about 3.0, preferably from 2.0 to 2.3 chemical equivalents of the aldehydic material are reacted with each mole of the phenol used. Particular resinous phenols are obtained by partially condensing, in appropriate portions to provide a thermosetting product, a phenol, such as phenol, cresol, resorcinol, or 3, 5-xylenol, with a suitable aldehydic material. Specific examples of suitable aldehydes, or similarly acting materials, are aqueous formaldehyde, paraformaldehyde, trioxymethylene, and the like methylene providing materials. Also operable are acetaldehyde, furfuraldehyde and the like aldehydic materials which react with the mentioned phenols to form soluable, thermosetting, binder products.

Although it is thought that any commercially available wax may be used in the present invention, paraffin waxes such as petrolatum waxes are presently preferred. The wax serves to act as a water repellant and as a sizing agent by keeping the cellulose fibers in suspension during the hardboard manufacturing process. Whatever kind of wax is used in the present invention, however, should have a high degree of water solubility.

In accordance with another embodiment of the present invention a novel and improved process for the manufacture of hardboard is provided. The inventive process comprises the steps of:

(a) forming an aqueous mixture comprising about 1–10 wt% solids, the solids portion of said mixture comprising the following ingredients:
  (i) about 1–10 wt % of a porous additive having a particle size in the range of about 0.1–2 mm;
  (ii) about 65–97 wt% of cellulose fibers;
  (iii) about 2–5 wt % binder; and
  (iv) About 1–4 wt % wax;
(b) thereafter, dewatering the aqueous mixture of (a) above; and
(c) heating the dewatered mixture formed in (b) above at a temperature and for a time sufficient to cure said binder.

Preferably the aqueous mixture will comprise 3∫7 wt % solids.

The solids portion will preferably comprise about 5–15 wt % porous additive, about 87–95 wt % cellulose fibers, about 2–3 wt % binder, and about 1–2 wt % wax.

The hardboard mixture is typically dewatered on a cold press at a gauge pressure of about 10–1200 psi for about 1–5 minutes.

After dewatering, the hardboard is transferred to a hot press wherein the hardboard is further dewatered, out-gassed, binder cured, and formed to the desired thickness. Preferably, the hot pressing takes place at a temperature in the range of about 150°–500° F. and at a pressure in the range of about 100–1200 psi for about 20 minutes.

The inventive process for forming the hardboard is easily distinguishable from the conventional hardboard manufacturing process. This is because both the dewatering cold press step and the hot press step are made more efficient due to the partial replacement of cellulose fiber with a porous additive such as expanded perlite.

The following example further illustrates the present invention

EXAMPLE

Several series of hardboard samples were made using mechanically opened (pulped), softwood (Douglas Fir) cellulose fibers, phenol-formaldehyde resin binder, and petrolatum wax as the basic components. Expanded perlite (PA 116 marketed by Manville Service Corporation) was added at varying percentages to determine the effect of perlite on hardboard properties.

For each sample, 2 liters of tap water were adjusted to a pH of 5 by adding acetic acid and were then heated to a temperature of 160°–170° F. The adjustment of the pH is done to aid in curing the resin and also to speed the curing time as well as precipitate the sizing agent (wax). The elevated water temperature helps aid dispersion of the wax emulsion and aids in heating the board prior to hot pressing. The wood fiber wax and heated water are added to a Tappi Mixer and agitated for 3 minutes. This mixer has sufficient shear to help pulp the wood fiber and disperse the wax. After 3 minutes the desired amount of resin (diluted to 10% solids) was added drop-by-drop to the mixer, while running. As soon as the binder has been added, the perlite was added and the entire mix was blended for 2 minutes. After mixing, the slurry was then placed in a 8" by 8" sheet mold with a 60 mesh screen. The mat was then deposited on the screen and the formation time (time from beginning of mat formation until the sound of suction) was recorded. The sheet was then removed from the mold and placed in a cold press for dewatering. The sheet was dewatered in the cold press until a gauge pressure of 1200 psi was reached. The amount of water removed was recorded (in mls) and the sheet was then placed in the hot press. The press was heated to 400° F. prior to pressing. Each sheet was pressed to a gauge reading of 12,500 lbs. on a $3\frac{5}{8}$" diameter ram (except for two standard samples which were pressed at lower pressures to produce lower board densities). Each sheet was left in the hot press for 15 minutes to ensure proper curing of the resin and complete drying of the board. The finished board was then removed from the press for testing at a later date.

The finished specimen was then measured, using calipers, and weighed to determine the board density. Each board was cut into one inch strips using a band saw. These samples were then tested for various properties such as Modulus of Rupture, tensile strength, elongation and Modulus of Elasticity. Test results are contained in Tables 1–3.

TABLE 1

Test Results on Hardboard Containing Varying Amounts of Resin & Perlite

| Hardboard Composition | | | | | Tension Tests[A] | | | |
|---|---|---|---|---|---|---|---|---|
| Fiber Content (% by wt) | Resin Content (% by wt) | Wax Content (% by wt) | Perlite Content (% by wt) | Board Density (pcf) | Modulus of Rupture (lb/in$^2$) | Tension Strength (lb/in$^2$) | Elong.[B] (in/in) | Modulus[C] of Elasticity[D] (KSI) |
| 97.0 | 1.0 | 2.0 | — | 51.6 | 4631 | 2072 | 0.0046 | 450.4 |
| 96.0 | 2.0 | 2.0 | — | 54.5 | 5483 | 2535 | 0.0052 | 487.7 |
| 95.0 | 3.0 | 2.0 | — | 54.2 | 5582 | 2680 | 0.0054 | 496.3 |
| 95.0 | 2.0 | 2.0 | 1.0 | 53.3 | 5360 | 2517 | 0.0052 | 484.0 |
| 93.0 | 2.0 | 2.0 | 3.0 | 52.2 | 5092 | 2441 | 0.0052 | 469.4 |
| 91.0 | 2.0 | 2.0 | 5.0 | 50.5 | 4899 | 2198 | 0.0051 | 431.0 |
| 86.0 | 2.0 | 2.0 | 10.0 | 46.5 | 4123 | 2026 | 0.0050 | 405.2 |
| 85.0 | 3.0 | 2.0 | 10.0 | 48.7 | 4271 | 2115 | 0.0051 | 414.7 |
| 76.0 | 2.0 | 2.0 | 20.0 | 42.6 | 2780 | 1440 | 0.0048 | 300.0 |
| 75.0 | 3.0 | 2.0 | 20.0 | 42.8 | 2901 | 1553 | 0.0049 | 316.9 |
| 67.2 | 1.4 | 1.4 | 30.0 | 41.5 | 1039 | 431 | 0.0030 | 143.7 |

TABLE 1-continued

Test Results on Hardboard Containing Varying Amounts of Resin & Perlite

| Hardboard Composition | | | | | Tension Tests[A] | | | |
|---|---|---|---|---|---|---|---|---|
| Fiber Content (% by wt) | Resin Content (% by wt) | Wax Content (% by wt) | Perlite Content (% by wt) | Board Density (pcf) | Modulus of Rupture (lb/in$^2$) | Tension Strength (lb/in$^2$) | Elong.[B] (in/in) | Modulus[C] of Elasticity[D] (KSI) |
| 66.0 | 2.0 | 2.0 | 30.0 | 40.2 | 1329 | 858 | 0.0043 | 199.5 |
| 65.0 | 3.0 | 2.0 | 30.0 | 38.7 | 1459 | 1012 | 0.0046 | 220.0 |
| 64.0 | 4.0 | 2.0 | 30.0 | 38.2 | 1600 | 1131 | 0.0048 | 235.6 |
| 63.0 | 5.0 | 2.0 | 30.0 | 38.6 | 1991 | 1181 | 0.0049 | 241.0 |

Notes;

[A]Tested according to ASTM D1037

[B]Elongation = $\frac{\text{Distance the sample was stretched when broken in tension (I)}}{\text{initial span (inches)}}$

[C]MOE = $\frac{\text{Tensile Strength}}{\text{Elongation (in tension)}}$

[D]KSI = kilopounds per square inch

The above data in Table 1 indicates that increasing the addition of perlite to hardboard results in decreased board densities. Even though the boards' strength and elasticity decreased with the addition of perlite, this is not critical to utilizing the inventive hardboard because hardboard requisite strength and elasticity can vary widely from usuage to usuage, i.e. whether its used for shingles, furniture backing, peg board, etc.

By way of qualitative observation it was noted that as the amount of perlite in each board increased the amount of board shrinkage decreased. In the hardboard samples that contained 30 wt% perlite there was no detactable loss in thickness.

TABLE 2

Filtration and Water Removal Properties of Hardboard Made with Expanded Perlite

| Hardboard Composition | | | | Formation | Water Removal* |
|---|---|---|---|---|---|
| Fiber Content (% by wt) | Resin Content (% by wt) | Wax Content (% by wt) | Perlite Content (% by wt) | Time (sec) | During Cold Pressing (ml) |
| 97.0 | 1.0 | 2.0 | — | 6.4 | 360 |
| 96.0 | 2.0 | 2.0 | — | 5.3 | 375 |
| 95.0 | 3.0 | 2.0 | — | 6.1 | 360 |
| 95.0 | 2.0 | 2.0 | 1.0 | 5.8 | 380 |
| 93.0 | 2.0 | 2.0 | 3.0 | 5.8 | 385 |
| 91.0 | 2.0 | 2.0 | 5.0 | 5.7 | 390 |
| 86.0 | 2.0 | 2.0 | 10.0 | 5.6 | 400 |
| 85.0 | 3.0 | 2.0 | 10.0 | 5.8 | 380 |
| 76.0 | 2.0 | 2.0 | 20.0 | 5.5 | 390 |
| 75.0 | 3.0 | 2.0 | 20.0 | 2.6 | 400 |
| 67.2 | 1.4 | 1.4 | 30.0 | 3.4 | 405 |
| 66.0 | 2.0 | 2.0 | 30.0 | 3.3 | 410 |
| 65.0 | 3.0 | 2.0 | 30.0 | 2.8 | 610 |
| 64.0 | 4.0 | 2.0 | 30.0 | 3.2 | 490 |
| 63.0 | 5.0 | 2.0 | 30.0 | 4.4 | 465 |

*All samples originally contained 2000 ml of $H_2O$ - some was removed during formation in the sheet mold, some during cold pressing and a little during hot pressing.

The above data in Table 2 clearly indicates that as the perlite content increased the formation time generally decreased and the water removal amount generally increased.

TABLE 3

Subjective Test on the Hardboard made with Perlite

| Hardboard Composition | | | | |
|---|---|---|---|---|
| Fiber Content (% by wt) | Resin Content (% by wt) | Wax Content (% by wt) | Perlite Content (% by wt) | Nail-ability |
| 97.0 | 1.0 | 2.0 | — | ok |
| 96.0 | 2.0 | 2.0 | — | ok |
| 95.0 | 3.0 | 2.0 | — | ok |
| 95.0 | 2.0 | 2.0 | 1.0 | ok |
| 93.0 | 2.0 | 2.0 | 3.0 | ok |
| 91.0 | 2.0 | 2.0 | 5.0 | ok |
| 86.0 | 2.0 | 2.0 | 10.0 | ok |
| 85.0 | 3.0 | 2.0 | 10.0 | ok |

TABLE 3-continued

Subjective Test on the Hardboard made with Perlite

| Hardboard Composition | | | | |
|---|---|---|---|---|
| Fiber Content (% by wt) | Resin Content (% by wt) | Wax Content (% by wt) | Perlite Content (% by wt) | Nail-ability |
| 76.0 | 2.0 | 2.0 | 20.0 | ok |
| 75.0 | 3.0 | 2.0 | 20.0 | ok |
| 67.2 | 1.4 | 1.4 | 30.0 | ok |
| 66.0 | 2.0 | 2.0 | 30.0 | ok |
| 65.0 | 3.0 | 2.0 | 30.0 | ok |
| 64.0 | 4.0 | 2.0 | 30.0 | ok |
| 63.0 | 5.0 | 2.0 | 30.0 | ok |

*Based on whether or not the board cracked when nailing the test specimen to a piece of 2" × 4" pine.

The above data indicates that the inventive hardboard has good physical properties when used in applications such as siding.

Reasonable modifications and variations are possible from the foregoing without departing from either the spirit or scope of the present invention.

I claim:

1. A hardboard material comprising:

(a) about 1–40 wt % of a porous additive having a particle size in the range of about 0.1–2 mm;

(b) about 65–97 wt % of cellulose fibers;

(c) about 2–5 wt % binder; and (d) about 1–4 wt % wax.

2. A hardboard material according to claim 1 comprising:

(a) about 5–15 wt % of said highly porous additive;
(b) about 87–95 wt % of said cellulose fibers;
(c) about 2–3 wt % of said binder; and
(d) about 1–2 wt % of said wax.

3. A hardboard material according to claim 1 wherein said wax is a paraffin wax.

4. A hardboard material according to claim 1 wherein said porous additive has a particle size of from about 0.5–1.5 mm.

5. A hardboard material according to claim 1 wherein said porous additive has a density of from about 3–30 pcf.

6. A hardboard material according to claim 5 wherein said porous additive has a density of from about 3–9 pcf.

7. A hardboard material according to claim 1 wherein said porous additive is expanded perlite.

8. A hardboard material according to claim 1 wherein said cellulose fibers are selected from kraft fibers and wood fibers.

9. A hardboard material according to claim 1 wherein said cellulose fibers are wood fibers.

10. A hardboard according to claim 1 wherein said binder is an organic binder.

11. A hardboard according to claim 10 wherein said binder is a phenolic resin.

12. An improved process for the production of hardboard comprising the steps of:

(a) forming an aqueous mixture comprising about 1–10% wt% solids, the solids portion of said mixture comprising the following ingredients:
  (i) about 1–10 wt % of a porous additive having a particle size in the range of about 0.1–2 mm;
  (ii) about 65–97 wt% of cellulose fibers;
  (iii) about 2–5 wt % binder;
  (iv) about 1–4 wt % wax;
(b) thereafter, dewatering the aqueous mixture of (a) above; and
(c) heating the dewatered mixture formed in (b) above at a temperature and for a time sufficient to cure said binder.

13. A process according to claim 12 wherein said aqueous mixture comprises about 3–7 wt % solids.

14. A process according to claim 12 wherein the solids portion of said mixture comprises:
(a) about 5–15 wt % of said highly porous additive;
(b) about 87–95 wt % of said cellulose fibers;
(c) about 2–3 wt % of said binder; and
(d) about 1–2 wt % of said wax.

15. A process according to claim 12 wherein said wax is a paraffin wax.

16. A process according to claim 12 wherein said porous additive has a density of from about 3–30 pcf.

17. A process according to claim 16 wherein said porous additive has a density of from about 3–9 pcf.

18. A process according to claim 12 wherein said porous additive is expanded perlite.

19. A process according to claim 12 wherein said cellulose fibers are selected from kraft fibers and wood fibers.

20. A process according to claim 12 wherein said cellulose fibers are wood fibers.

21. A process according to claim 12 wherein said binder is an organic binder.

22. A process according to claim 21 wherein said binder is a phenolic resin.

23. A process according to claim 12 wherein the dewatering in step (b) is conducted on a cold press.

24. A process according to claim 12 wherein the heating in step (c) is conducted in one stage on a hot press.

* * * * *